US012163739B2

(12) United States Patent
Cennamo et al.

(10) Patent No.: US 12,163,739 B2
(45) Date of Patent: Dec. 10, 2024

(54) METHOD AND APPARATUS FOR FORMING LIQUID FILLED HEAT TRANSFER DEVICE

(71) Applicant: Aavid Thermalloy, LLC, Laconia, NH (US)

(72) Inventors: John R. Cennamo, Gilford, NH (US); Christopher McPherson, Meredith, NH (US)

(73) Assignee: Aavid Thermalloy, LLC, Laconia, NH (US)

( * ) Notice: Subject to any disclaimer, the term of this patent is extended or adjusted under 35 U.S.C. 154(b) by 0 days.

(21) Appl. No.: 17/009,054

(22) Filed: Sep. 1, 2020

(65) Prior Publication Data

US 2021/0063094 A1 Mar. 4, 2021

Related U.S. Application Data

(63) Continuation of application No. PCT/US2020/048464, filed on Aug. 28, 2020.
(Continued)

(51) Int. Cl.
*F28D 15/02* (2006.01)
*F28D 15/04* (2006.01)
(Continued)

(52) U.S. Cl.
CPC ..... *F28D 15/0233* (2013.01); *F28D 15/0283* (2013.01); *F28D 15/04* (2013.01);
(Continued)

(58) Field of Classification Search
CPC ..... F28D 15/0233; F28D 15/0258; F28D 15/0283; F28D 15/046; H01L 23/427
(Continued)

(56) References Cited

U.S. PATENT DOCUMENTS 6,158,502 A 12/2000 Thomas
6,230,407 B1 * 5/2001 Akutsu ..... F28D 15/0233 29/890.032
(Continued)

FOREIGN PATENT DOCUMENTS

WO WO-2018139568 A1 * 8/2018 ..... F28D 15/0233

OTHER PUBLICATIONS

Invitation to Pay Additional Fees for International Application No. PCT/US2020/048464, mailed Dec. 4, 2020.
(Continued)

*Primary Examiner* — Joel M Attey
*Assistant Examiner* — For K Ling
(74) *Attorney, Agent, or Firm* — Wolf, Greenfield & Sacks, P.C.

(57) ABSTRACT

A heat transfer device includes three plates sandwiched together to form a vapor chamber or similar device. The three plates may be sealingly joined at a closed periphery to define a closed volume that contains a working fluid. One or more of the three plates may include structure to support capillary or other working fluid flow in the closed volume, e.g., a center plate may include openings and/or other structure to permit working fluid flow through and/or along the plate. An outer one of the plates may include an opening through which working fluid may be introduced into the closed volume. After filling with working fluid, the plates may be sealingly joined at one or more joints that extend chordwise across the closed periphery, e.g., so a portion of the plate that defines the opening can be removed from the device.

8 Claims, 1 Drawing Sheet

Related U.S. Application Data

(60) Provisional application No. 62/892,623, filed on Aug. 28, 2019.

(51) Int. Cl.
*F28F 3/02* (2006.01)
*F28F 3/08* (2006.01)

(52) U.S. Cl.
CPC ..... *F28D 15/046* (2013.01); *F28F 3/027* (2013.01); *F28F 3/08* (2013.01)

(58) Field of Classification Search
USPC ..... 165/104.26
See application file for complete search history.

(56) References Cited

U.S. PATENT DOCUMENTS

| | | | | |
|---|---|---|---|---|
| 7,464,463 | B2 | 12/2008 | Lin et al. | |
| 7,469,740 | B2 | 12/2008 | Lin et al. | |
| 7,677,299 | B2 * | 3/2010 | Zheng | H01L 23/427 165/104.33 |
| 2006/0000579 | A1 | 1/2006 | Whitney et al. | |
| 2006/0096740 | A1 | 5/2006 | Zheng | |
| 2006/0213647 | A1 * | 9/2006 | Lin | H01L 21/4882 165/104.26 |
| 2010/0008043 | A1 * | 1/2010 | Yajima | F28D 15/046 361/700 |
| 2010/0251547 | A1 * | 10/2010 | Yajima | H01L 23/427 29/890.03 |
| 2011/0253345 | A1 * | 10/2011 | Ryoson | B23K 20/16 165/104.26 |
| 2016/0377353 | A1 | 12/2016 | Bozorgi et al. | |
| 2017/0059254 | A1 * | 3/2017 | Zhang | F28D 15/0233 |
| 2019/0360762 | A1 * | 11/2019 | Aoki | F28D 15/0233 |

OTHER PUBLICATIONS

International Search Report and Written Opinion for International Application No. PCT/US2020/048464, mailed Feb. 5, 2021.
International Preliminary Report on Patentability for International Application No. PCT/US2020/048464, mailed Mar. 10, 2022.

* cited by examiner

METHOD AND APPARATUS FOR FORMING LIQUID FILLED HEAT TRANSFER DEVICE

RELATED APPLICATIONS

This application claims priority under 35 U.S.C. § 120 to and is a continuation of International PCT Application No. PCT/US2020/048464, filed Aug. 28, 2020, which claims the benefit of U.S. Provisional Application No. 62/892,623, filed Aug. 28, 2019.

BACKGROUND OF INVENTION

1) Field of Invention

This invention relates generally to heat transfer devices that employ a two-phase fluid to transfer heat between locations.

2) Description of Related Art

Planar heat pipes or vapor chambers are widely used for cooling systems, such as integrated circuits and other computer circuitry. For example, U.S. Pat. No. 6,167,948 discloses planar heat spreader arrangements for cooling electronic components or other heat generating elements.

SUMMARY OF INVENTION

One aspect of the invention provides a heat transfer device that includes a first plate having an inner surface and an outer surface, and a second plate having an inner surface, an outer surface and an opening extending from the outer surface to the inner surface. The first and second plates are positioned with respective inner surfaces facing each other and the plates are sealed together about a closed periphery that extends around the opening to define a closed volume. The first and second plates are also sealingly joined along a first joint, and optionally along a second joint, that extends chordwise across the closed periphery. The first joint defines with the closed periphery a first portion of the closed volume that includes the opening. If the second joint is provided, the first joint is positioned closer to the opening than the second joint, and the first and second joints together with the closed periphery define a second portion of the closed volume, and the second joint together with the closed periphery defines a third portion of the closed volume. The second portion of the closed volume may isolate non-condensable gas from working fluid in the third portion, which may be adapted to function as a heat spreader, vapor chamber or other heat transfer device. If the second joint is not provided, the first joint and the closed periphery define a third portion of the closed volume and no second portion is defined.

The first and second plates may each include a U-shaped or other extension having a proximal end and a distal end, with the second plate including the opening near a distal end of the U-shaped extension of the second plate. The second joint may be located at the proximal ends of the U-shaped extensions of the first and second plates, and the first joint may be formed between the second joint and the distal ends of the U-shaped extension. Where the second joint is not provided, the first joint can be located at the proximal ends of the U-shaped extensions. The first joint and/or the second joint may be formed by clamping the first and second plates together and/or by welding, brazing or soldering the first and second plates together.

In some embodiments, a third plate may be positioned between the first and second plates, and the first, second and third plates may be sealed together about the closed periphery to define the closed volume. The third plate may be arranged to influence or otherwise control flow of working fluid in the closed volume, e.g., the closed volume may include a first section between the inner surface of the first plate and the third plate, and a second section between the inner surface of the second plate and the third plate. The third plate may include openings to permit fluid communication for the working fluid between the first and second sections of the closed volume, and/or other structural features such as grooves, bumps, channels, etc., e.g., to cause capillary flow of working fluid in one or more areas of the closed volume. For example, the inner surface of the first plate, the inner surface of the second plate and/or the third plate may include structures to provide for fluid flow between the inner surface of the first plate and the third plate, and for fluid flow between the inner surface of the second plate and the third plate. In one illustrative embodiment, the first plate may be arranged to receive heat into the working fluid from a heat source, and the second plate may be arranged to transfer heat from the working fluid to an exterior environment, such as surrounding air, a heat pipe, a chiller plate, etc. The first plate and/or third plate may include capillary flow structures to encourage liquid flow and/or collection in the first section of the closed volume, and the second plate and/or third plate may include pins, posts or other features to encourage vapor flow and condensing in the second section of the closed volume.

In one embodiment, the second plate may include a plurality of openings, and the first and second plates may be sealingly joined together at a plurality of closed peripheries that each extend around a corresponding one of the plurality of openings. Thus, a plurality of heat transfer devices may be formed by the first and second plates (and a third plate if provided).

In another embodiment, a heat transfer device includes a first plate having an inner surface and an outer surface, a second plate having an inner surface and an outer surface, and a third plate between the first and second plates with the third plate including first and second sides respectively adjacent the first and second plates. The first, second and third plates may be sealed together about a closed periphery to define a closed volume between the first and second plates with the closed volume containing a working fluid. A first section of the closed volume may be defined between the inner surface of the first plate and the third plate, and a second section of the closed volume may be defined between the inner surface of the second plate and the third plate. The third plate may include one or more openings to permit fluid communication for the working fluid between the first and second sections of the closed volume.

In one embodiment, the first plate is adapted to receive heat from a heat source, and the first section of the closed volume is adapted to hold working fluid in liquid form for vaporization. The second section of the closed volume may be adapted to hold and allow flow of working fluid in vapor form for condensing. For example, the first and/or third plate may include structural features for capillary flow of working fluid in the first section, e.g., to encourage collection of liquid form working fluid in the first section for receipt of heat and vaporization. In contrast, the second and/or third plate may include structural features to allow flow and condensing of vapor form working fluid in the second section.

In one embodiment, the second plate includes an opening extending from the outer surface to the inner surface, and the closed periphery extends around the opening to define the closed volume. The first, second and third plates may be sealingly joined along a first joint, and optionally a second joint, that extends chordwise across the closed periphery, with the first joint being positioned closer to the opening than the second joint where the second joint is provided. The first joint with the closed periphery may define a first portion of the closed volume that includes the opening, and the first and second joint together with the closed periphery may define a second portion of the closed volume. The second joint together with the closed periphery may define a third portion of the closed volume, or the first joint together with the closed periphery may define a third portion of the closed volume where the second joint is not provided. The second portion of the closed volume may contain non-condensable gas, and the third portion of the closed volume may include the working fluid and be adapted to function as a heat spreader.

In some cases, the first, second and third plates may each include a U-shaped extension having a proximal end and a distal end, with the second plate including the opening near a distal end of the U-shaped extension of the second plate. The second joint may be located at the proximal ends of the U-shaped extensions of the first and second plates, and the first joint may be formed between the second joint and the distal ends of the U-shaped extension. Where the second joint is not provided, the first joint can be located at the proximal ends of the U-shaped extensions. The first joint and/or second joint may be formed by clamping the plates together, and/or by welding, brazing or soldering the first, second and third plates together.

These and other aspects of the invention will be apparent from the following description. Also, it should be appreciated that different aspects of the invention may be combined in a variety of different ways.

BRIEF DESCRIPTION OF THE DRAWINGS

The accompanying drawings, which are incorporated in and form a part of the specification, illustrate select embodiments of the present invention and, together with the description, serve to explain the principles of the inventions. In the drawings.

DETAILED DESCRIPTION

Figure 1:
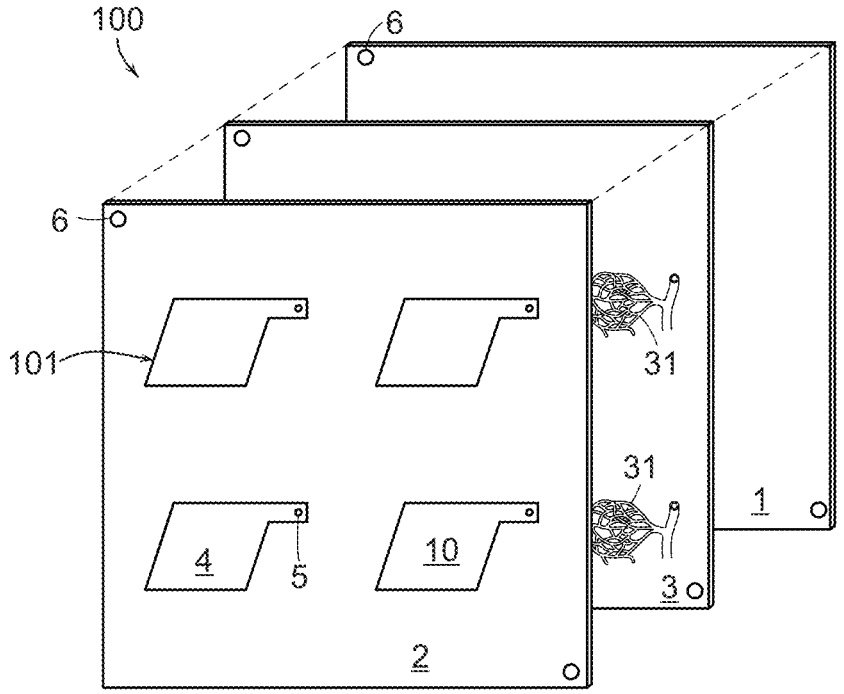
FIG. 1 is an exploded perspective view of a heat transfer device in an illustrative embodiment that incorporates aspects of the invention.

Aspects of the invention are not limited in application to the details of construction and the arrangement of components set forth in the following description or illustrated in the drawings. Other embodiments may be employed and aspects of the invention may be practiced or be carried out in various ways. Also, aspects of the invention may be used alone or in any suitable combination with each other. Thus, the phraseology and terminology used herein is for the purpose of description and should not be regarded as limiting.

FIG. 1 shows an exploded view of a heat transfer device assembly 100. In this embodiment, a plurality of heat transfer devices 101 are formed, e.g., which each may function as a vapor chamber, heat spreader, planar heat pipe or similar device for transferring heat from one or more locations to one or more other locations. For example, the heat transfer devices 101 may be used to help cool an integrated circuit device or other electronic device. In this embodiment, first, second and third plates 1, 2, 3 are joined together to form a layered or sandwiched structure from which the heat transfer devices 101 are formed. The first, second and/or third plates 1, 2, 3 may be metal sheets, e.g., of aluminum, copper or other suitable material, whether metal, polymer, composite, etc. The first and second plates 1, 2 define the outer surfaces of the heat transfer devices 101, and the third plate 3 may be provided between the first and second plates 1, 2, e.g., to function as a capillary-defining structure 31 between the first and second plates 1, 2 to help move liquid and vapor components of a working fluid in a closed volume 10 between the first and second plates 1, 2, and/or to otherwise help control flow of working fluid in a closed volume 10 of the heat transfer device 101. The third plate 3 has first and second sides respectively adjacent the inner surfaces of the first and second plates 1, 2, and thus the closed volume 10 includes a first section between the inner surface of the first plate 1 and the third plate 3, and a second section between the inner surface of the second plate 2 and the third plate 3. Note that the third plate may include openings or other flow channels 31 for capillary flow or to permit fluid communication for the working fluid in the closed volume between the first and second sections of the closed volume. A third plate 3 is not required, however. For example, spacers, bumps on the first and/or second plates 1, 2 or other structures may be provided as desired to influence working fluid flow in the closed volume 10, as discussed in more detail below. The first, second and/or third plates 1, 2, 3 may include registration openings, pins or other structure 6 to align the plates 1, 2, 3 when assembled together. This may help properly position openings 5, capillary or other flow structure 31, etc. on the first, second and/or third plates 1, 2, 3.

Inner surfaces of the first and second plates 1, 2 are positioned adjacent or facing each other, e.g., with the third plate 3 between the first and second plates 1, 2 where a third plate 3 is provided. The first and second plates 1, 2 are sealingly joined to each other at one or more closed peripheries 4, e.g., by welding, soldering, brazing, adhesive or other means, to define one or more heat transfer devices 101. The first and second plates 1, 2 may be joined directly together, or may have an intervening part such as the third plate 3, a seal, or other structure between the first and second plates 1, 2 at the joint. In this embodiment, the first, second and third plates 1, 2, 3 are joined together at the closed peripheries 4 to define respective closed volumes 10. The second plate 2 may include one or more openings 5 extending from the outer surface to the inner surface of the second plate 2, and the closed peripheries 4 may each extend around a corresponding opening 5 to define the closed volume 10. The opening 5 for each heat transfer device 101 may allow working fluid, such as liquid water, to be provided into the closed volume 10 of the heat transfer device 101. As is known in the art, the working fluid may receive heat from a heat source, e.g., via the first plate 1, that causes liquid working fluid to vaporize and flow to cooler areas of the heat transfer device 101. The vapor form working fluid may transfer heat away, e.g., through the second plate 2, that causes the vapor to condense to liquid form. This cyclical action may allow the heat transfer device 101 to receive heat at one location and move the heat to one or more other locations.

Figure 2:
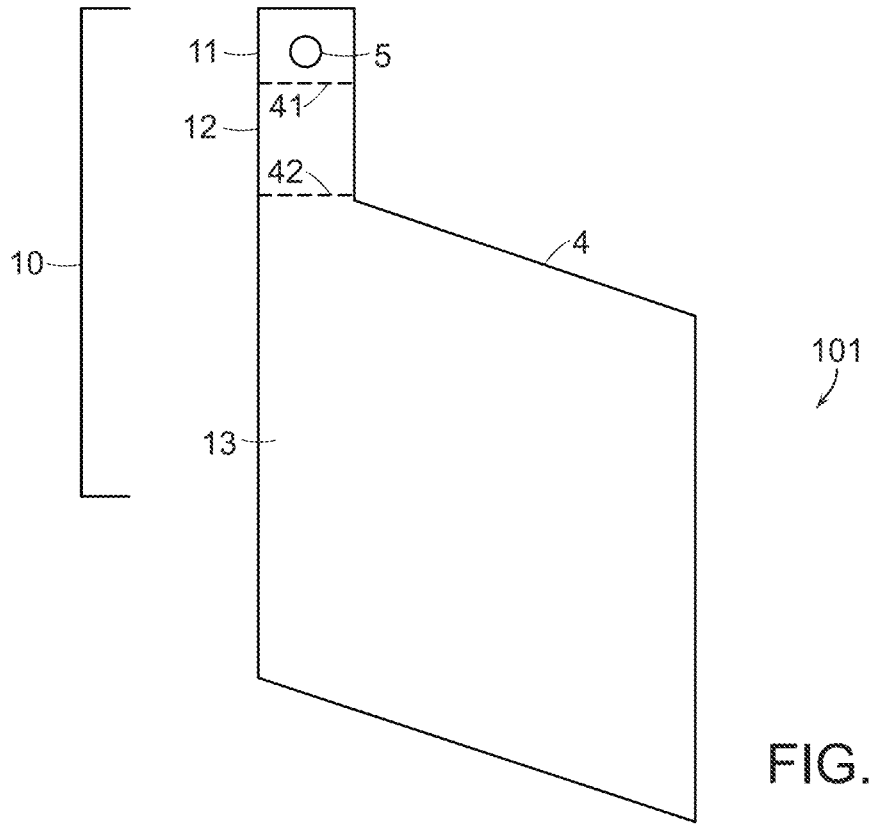
FIG. 2 is a plan view of a heat transfer device separated from other heat transfer devices in the FIG. 1 embodiment.

FIG. 2 shows a plan view of a heat transfer device 101 that has been separated from other heat transfer devices 101 formed by the first, second and third plates 1, 2, 3 in FIG. 1. In this embodiment, the closed periphery 4 has a roughly parallelogram shape and a U-shaped extension at an upper end, but it should be understood that the closed periphery 4 may have any suitable shape, such as rectangular, oval, round, irregular, etc. and the extension may likewise be shaped in any suitable way. Thus, in this embodiment the first and second plates 1, 2 (and the third plate 3 where provided) each have a U-shaped extension that includes the opening 5 of the second plate 2, e.g., near a distal end of the U-shaped extension. Working fluid may be provided into the closed volume 10 of the heat transfer device 101 through the opening 5, which if introduced in liquid form will tend to flow toward the bottom of the closed volume 10. Any gas in the closed volume 10 may be evacuated at least in part before the introduction of working fluid into the closed volume 10, and any remaining gas may be removed from the closed volume 10 as the gas is displaced by liquid-form working fluid introduced into the closed volume 10. With the closed volume 10 at least partly filled with working fluid, the first and second plates 1, 2 (and the third plate 3) may be sealingly joined along a first joint 41 that extends chordwise across the closed periphery 4 to define a first portion 11 of the closed volume that includes the opening 5. This first joint 41 may be formed by clamping the first, second and third plates 1, 2, 3 together, by welding, adhering, or otherwise attaching the plates 1, 2, 3 to each other, etc., and may serve to seal the closed volume 10. Although in FIG. 2 the first joint 41 is formed near the opening 5, the first joint 41 could be formed in other places on the extension, e.g., at the proximal end of the extension.

Even with best efforts, at least some non-condensable gas or other undesirable gas may be present with the working fluid in the closed volume 10 after the first joint 41 is formed. To remove this non-condensable gas, the working fluid may be refluxed, e.g., heated to cause all or at least part of the working fluid to vaporize in the closed volume 10, and then cooled to cause all or at least part of the working fluid to condense to a liquid. Any suitable number of reflux cycles may be performed, and as a result, non-condensable gas may tend to collect in a second portion 12 of the closed volume below the first joint 41. With the non-condensable gas located in the second portion 12, a second joint 42 may be formed that extends chordwise across the closed periphery 4 so that the first and second joints 41, 42 together with the closed periphery 4 define the second portion 12 of the closed volume 10 and so that the first joint 41 is closer to the opening 5 than the second joint 42. For example, the second joint 42 may be located at the proximal ends of the U-shaped extensions of the first and second plates 1, 2, and the first joint 41 may be formed between the second joint 42 and the distal ends of the U-shaped extensions. At the second joint 42, the first, second and/or third plates 3 may be sealingly joined together, e.g., by welding, brazing, soldering, adhesive, clamping, etc. Forming of the second joint 42 may also isolate working fluid in a third portion 13 of the closed volume 10 from any non-condensable gas in the second portion 12. Thereafter, the parts of the first, second and/or third plates 1, 2, 3 that form the U-shaped extension (or otherwise form the first and second portions 11, 12 of the closed volume 10) may be cut or otherwise removed from the remaining parts of the first, second and/or third plates 1, 2, 3 that define the third portion 13 of the closed volume 10. This third portion 13 may be used as a finished or functioning heat transfer device, such as a heat spreader, planar heat pipe, vapor chamber, etc. Where the second joint 42 is not provided, the first joint 41 can be formed in the location where the second joint 42 is formed (or in other places). In this case, the first joint 41 will form with the closed periphery 4 a first portion 11 and a third portion 13 (no second portion of the closed volume 10 is formed when no second joint is provided).

In some aspects, methods for forming a heat transfer device 101 as described above are inventive. One such method can include sealingly joining first, second and/or third plates together at a closed periphery that extends around an opening in the first or second plates, introducing working fluid into a closed volume 10 defined by the plates and the closed periphery via the opening, refluxing the working fluid or otherwise causing non-condensable gases to collect in an area of the closed volume, and sealing the plates at a first or second joint to isolate one portion of the closed volume containing more non-condensable gases from another portion of the closed volume that contains less non-condensable gas.

The part of the heat transfer device 101 that defines the third portion 13 of the closed volume 10 may operate in any suitable way to transfer heat with respect to a heat source. For example, the first plate 1 may be adapted to receive heat from a heat source, and the first section of the closed volume 10 defined between the first plate 1 and the third plate 3 may be adapted to hold working fluid in liquid form for vaporization. For example, the inner surface of the first plate 1 and/or the third plate 3 may have a relatively fine capillary structure to cause liquid to flow into and tend to remain in the first section of the closed volume 10. This may help position liquid-form working fluid in the first section of the closed volume 10 for receipt of heat for vaporization. In contrast, the inner surface of the second plate 2 and/or the third plate 3 may include coarser structure, such as relatively large and/or widely spread post features that permit vapor flow and generally discourage liquid from collecting and remaining in the second section of the closed volume 10 between the inner surface of the second plate 2 and the third plate 3. The third plate 3 may include a plurality of openings or other flow channels to permit working fluid to flow between the first and second sections of the closed volume 10. Note that the structure on the first, second and/or third plates 1, 2, 3 may also function to space the inner surfaces of the first and second plates 1, 2 from the third plate 3 (or from each other where no third plate 3 is provided) so that the closed volume 10 is defined to have a desired volume and is not collapsed by external pressure or other forces on the heat transfer device 101. For example, the heat transfer device 101 may be clamped to a heat source, and the structure on the first, second and/or third plates 1, 2, 3 may maintain spacing between the plates and resist collapsing of the closed volume 10.

The embodiments provided herein are not intended to be exhaustive or to limit the invention to a precise form disclosed, and many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. Although the above description contains many specifications, these should not be construed as limitations on the scope of the invention, but rather as an exemplification of alternative embodiments thereof.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

The use of "including," "comprising," "having," "containing," "involving," and/or variations thereof herein, is meant to encompass the items listed thereafter and equivalents thereof as well as additional items.

It should also be understood that, unless clearly indicated to the contrary, in any methods claimed herein that include more than one step or act, the order of the steps or acts of the method is not necessarily limited to the order in which the steps or acts of the method are recited.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

The invention claimed is:

1. A heat transfer device comprising:

a first plate that is a planar sheet having an inner surface and an outer surface;

a second plate that is a planar sheet having an inner surface, an outer surface and an opening extending from the outer surface to the inner surface; and a third plate between the first and second plates;

wherein the first, second and third plates are sealed together about a closed periphery that extends around the opening to define a closed volume, the closed volume including a first section between the third plate and the inner surface of the first plate, and a second section between the third plate and the inner surface of the second plate, the first, second and third plates being sealingly joined along a first joint that extends chordwise across the closed periphery, the first joint defining with the closed periphery a first portion of the closed volume that includes the opening in the second plate and a second portion of the closed volume that includes a working fluid and is adapted to function as a heat spreader, the first joint sealing the second portion closed so as to isolate the second portion from the first portion and to permit removal of parts of the first and second plates that form the first portion including the opening from parts of the first and second plates that form the second portion and maintain the second portion of the closed volume sealed for use as a heat spreader, wherein the first and third plates include no openings in the first portion of the closed volume.

2. The heat transfer device of claim 1, wherein the first and second plates each include a U-shaped extension having a proximal end and a distal end, the second plate including the opening nearer the distal end than the proximal end of the U-shaped extension of the second plate.

3. The heat transfer device of claim 2, wherein the first joint is located at the proximal ends of the U-shaped extensions of the first and second plates.

4. The heat transfer device of claim 1, wherein the first joint is formed by welding, brazing or soldering the first, second and third plates together.

5. The heat transfer device of claim 1, wherein the third plate includes openings to permit fluid communication for the working fluid between the first and second sections of the closed volume.

6. The heat transfer device of claim 1, wherein the third plate includes structures to provide for capillary fluid flow between the inner surface of the first plate and the third plate.

7. The heat transfer device of claim 6, wherein the third plate is a unitary structure.

8. The heat transfer device of claim 1, wherein the second plate includes a plurality of openings, and the first and second plates are sealingly joined together at a plurality of closed peripheries that each extend around a corresponding one of the plurality of openings.

* * * * *